United States Patent [19]

Reinschreiber

[11] 4,268,960

[45] May 26, 1981

[54] KNIFE WITH BLADE LOCKING MECHANISM

[75] Inventor: Merwyn R. Reinschreiber, Lyndhurst, Ohio

[73] Assignee: Cole Consumer Products, Inc., Cleveland, Ohio

[21] Appl. No.: 62,671

[22] Filed: Aug. 1, 1979

[51] Int. Cl.[3] ..... B26B 1/00

[52] U.S. Cl. ..... 30/161

[58] Field of Search ..... 30/161, 160

[56] References Cited

U.S. PATENT DOCUMENTS

| | | | |
|---|---|---|---|
| 2,263,415 | 11/1941 | Berg | 30/160 |
| 3,783,509 | 1/1974 | Lake | 30/161 |
| 4,040,181 | 8/1977 | Johnson | 30/161 |

FOREIGN PATENT DOCUMENTS

| | | | |
|---|---|---|---|
| 740133 | 11/1955 | United Kingdom | 30/161 |

*Primary Examiner*—Jimmy C. Peters

*Attorney, Agent, or Firm*—Fay & Sharpe

[57] ABSTRACT

A knife of the type having a blade which is selectively pivotally movable between extended and retracted positions relative to a handle. A rocker arm received between a pair of handle side portions is pivotally affixed thereto at the handle forward end and includes a locking member depending therefrom which is lockingly received in a knife blade locking notch when the blade is in the extended position. A leaf spring also disposed between the handle side portions acts against the rocker arm to continuously pivotally urge the locking member into engagement with the knife blade locking notch. The rocker arm extends axially outward from the rear of the handle side portions and has a pair of rear bolster members affixed thereto. These rear bolsters are selectively movable relative to the rear end edges of the handle side portions against the force of the leaf spring. Such movement pivots the rocker arm about its pivot mounting to move the locking member out of the locking notch and allow the knife blade to be moved to the retracted position. The rear bolsters are dimensioned and configured so that when the blade is in either one of the extended or retracted positions, they appear to be integral with the overall handle construction.

7 Claims, 5 Drawing Figures

KNIFE WITH BLADE LOCKING MECHANISM

BACKGROUND OF THE INVENTION

This invention pertains to the art of knives and more particularly to folding knives.

The invention is particularly applicable to a folding knife which includes positive locking means for locking the knife blade in an extended or operative position and will be described with particular reference thereto. However, it will be appreciated by those skilled in the art that the invention has broader uses and applications.

Folding knives themselves are well known in the art and comprise many types and styles. Such knives typically include a handle having an elongated knife blade pivotally mounted thereto. The knife blade may be conveniently pivoted from an extended or operative position in general longitudinal alignment with the handle to a retracted position wherein at least the blade cutting edge is received in a receiving channel or pocket defined by the handle. In the more simplistic designs, a rocker arm or spring exerts a continuous biasing force against a blade mounting tang so as to have a tendency to retain the blade in either of the extended or retracted positions. However, since such spring mechanisms do not facilitate positive blade locking, the blade can be inadvertently and suddenly moved from the extended position toward the retracted position during knife use to create the potential for serious injury.

There have also been a number of foldable knife designs which have included positive locking means as a part thereof for preventing undesired or premature knife closings. Typically, such positive locking means have comprised cooperating locking members and locking notches to achieve positive blade retention at least when it is in an extended or operative position. Various release means disposed in or adjacent the handle facilitate selective release of the locking means to permit knife closing. Most of these prior designs are generally satisfactory for locking purposes, at least when the knives are new or have been kept clean at all times. However, the release means normally associated therewith are typically plainly visible to the eye when merely viewing or otherwise examining the knife constructions. Although the visibility and location of such release mechanisms do not generally affect knife operation, they can and do detract from the overall knife aesthetics.

Thus, it has been considered desirable to provide a knife construction which includes a blade locking mechanism which does not involve a complicated or sophisticated construction and wherein the locking mechanism and the release means therefor are hidden from view. The subject invention is deemed to meet these needs as well as others generally associated with prior knife blade locking mechanisms.

BRIEF DESCRIPTION OF THE INVENTION

The subject invention is directed to a self locking knife construction wherein the rear bolster of the knife handle is movable in a generally linear manner relative to the handle side portion rear end areas to release a mechanical locking connection between a rocker arm associated with the handle and knife blade at cooperating locking notch and locking member areas.

In accordance with a preferred aspect of the subject invention, the handle includes a pair of laterally spaced apart parallel side portions secured in fixed relationship to each other for defining an elongated knife blade receiving channel therebetween. The knife blade has an elongated cutting edge portion and a tang portion. The blade is mounted by the tang portion to the handle adjacent one end thereof for allowing pivotal blade movement between an extended position having the cutting edge portion exposed and a retracted position having at least the cutting edge portion received in the channel. The tang portion includes a locking notch for receiving a releaseable locking member when the blade is in the extended position whereby the blade is locked against further pivotal movement. An elongated rocker arm is pivotally mounted between the handle side portions to extend over at least a major portion of the handle length. The rocker arm forms a wall-like area between the handle side portions to thus define a pocket for at least the blade cutting edge portion when the blade is retracted. This rocker arm also includes a forward end having a locking member lockingly engaging the blade tang portion locking notch in the blade extended position and a rearward end extending axially beyond handle side portion rear end areas. Spring biasing means received in the pocket acts against the rocker arm rearwardly of the pivot mounting therefor to continuously urge the locking member into engagement with the tang portion. Means defining a handle end is fixedly secured to the rocker arm rearward end at the handle side portion rear end areas. The end defining means is selectively movable relative to the rear end areas against the force of the spring biasing means to pivot the rocker arm about its pivot mounting so that the locking member is moved out of engagement with the locking notch.

In accordance with another aspect of the present invention, the outer edge of the rocker arm extends substantially flush and coextensive with the handle side portions over the longitudinal extents thereof at least when the blade is in either of the extended and retracted positions. The rocker arm rearward end includes a portion spaced outwardly from and generally coextensive with the side portion rear end areas and the handle end defining means comprises opposed bolster plates fixedly secured to the rocker arm rearward end portion.

According to a further aspect of the present invention, the rear end areas of the handle side portions taper toward the handle one end from the side edges thereof associated with the rocker arm toward the opposite side edges to facilitate selective movement of the end cover bolster plates and rocker arm rearward end portion relative to the side portion rear end areas at least when it is desired to release the locking relationship between the locking member and locking notch. The inner end edge of each bolster plate is closely spaced to the rear end area of an associated one of the handle side portions at least when the blade is in either the extended or retracted position. This relationship gives the appearance that the bolster plates are integral with the handle side wall portions.

The principal object of the present invention is the provision of a new and improved foldable knife construction which includes a blade locking mechanism.

Another object of the present invention is the provision of such a knife construction which is simple in design, easy to manufacture and reliable in use.

Still another object of the present invention is the provision of the aforementioned knife construction in which the locking mechanism and locking mechanism release means are not readily visible upon viewing or examination of the knife.

Still other objects and advantages to the present invention will become apparent to those skilled in the art upon a reading and understanding of the following specification.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein.

DESCRIPTION OF THE PREFERRED EMBODIMENT

Figure 1:
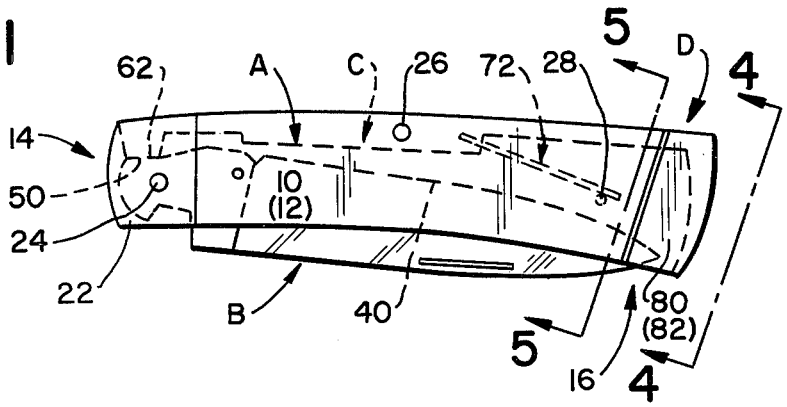
FIG. 1 is a side elevational view of the subject knife construction with the blade in the retracted position.

Referring now to the drawings wherein the showings are for purposes of illustrating the preferred embodiment of the invention only and not for purposes of limiting same, the FIGURES show a foldable knife construction comprised of a handle A, a blade B, a rocker arm C and a locking member release D.

Figure 2:
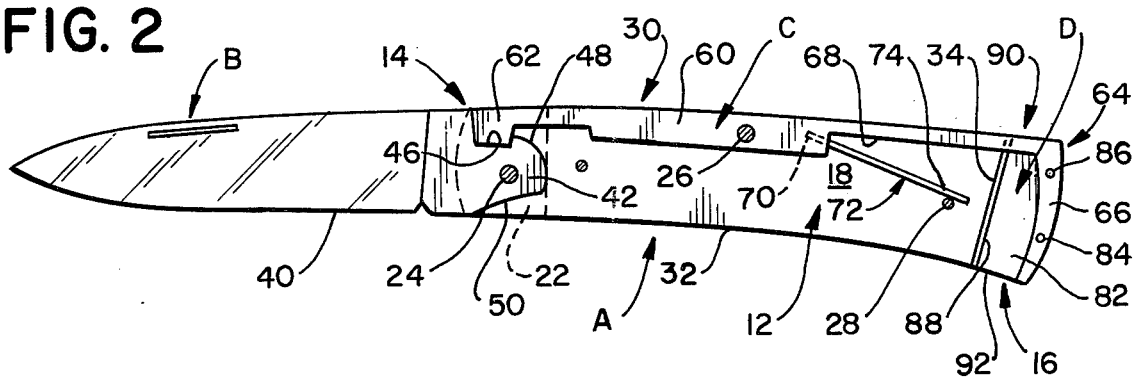
FIG. 2 is a side elevational view of the knife with the blade in the extended or operative position and with one side of the knife handle removed for ease of illustration.

With particular reference to FIGS. 1 and 2, handle A is comprised of opposed laterally spaced apart and parallel sides 10,12 having a forward or first end 14 and a rear or second end 16. Sides 10,12 comprise opposite, identical constructions with each including an elongated metal side or base plate 18 (FIGS. 2 and 5) extending over the handle length. An elongated decorative covering constructed from plastic, wood, bone, or any other convenient material is fixedly secured to the side or base plate 18 of each handle side 10,12 by convenient means. Such means typically involve the use of pins or dowels as is known in the art. To provide rigidity at the area of pivotal mounting for blade B, each of sides 10,12 includes a front bolster 22 fixedly secured to the associated side or base plate 18 adjacent handle forward or first end 14. These front bolsters are constructed from a rigid material such as steel or the like as is also known in the art. A plurality of spaced apart pins 24,26 and 28 rigidly interconnect sides 10,12 in a conventional transversely spaced apart generally parallel relationship to each other. Each of pins 24,26 and 28 performs a secondary function which will become more readily apparent hereinafter. While the foregoing description with regard to the construction of handle A relates to the preferred embodiment utilized in the subject invention, it will be appreciated by those skilled in the art that other types and styles of handle constructions could also be advantageously utilized when practicing the overall inventive concepts disclosed.

Sides 10,12 of handle A each include a longitudinal top side edge 30, a longitudinal bottom side edge 32 and a rear end edge 34. As will be noted from FIGS. 1 and 2, rear end edges 34 each taper somewhat toward handle forward or first end 14 from top side edge 30 toward bottom side edge 32. The reasons for this taper will become apparent hereinafter. The laterally spaced apart relationship between sides 10,12 defines a channel 36 adapted to receive at least a portion of blade B when the blade is moved to its retracted position.

With particular reference to FIG. 2, blade B includes an elongated cutting edge portion 40 and a tang or mounting portion 42. The blade is mounted between handle sides 10,12 for pivotal movement relative thereto by means of a pin 24 which is received through a mounting opening included in the tang portion. Tang portion 42 also includes a locking notch 46, a cam surface generally designated 48 and a relief-like area 50 generally oppositely disposed from the locking notch. The precise functions of the locking notch, cam surface and relief-like area will become more readily apparent hereinafter. Blade B itself may be constructed from any number of different steels or the like and locking notch 46, cam surface 48 and relief-like area 50 may assume slightly different configurations from those shown without in any way departing from the overall intent or scope of the present invention.

Figure 5:
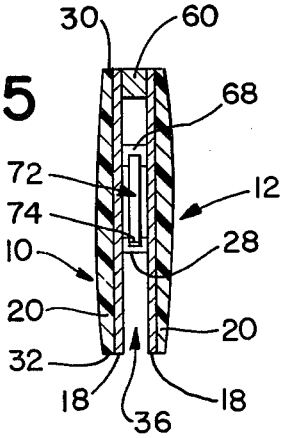

Rocker arm C includes an elongated rocker arm body generally designated 60 pivotally mounted to handle A between sides 10,12 by pin member 26. The rocker arm body includes a downwardly depending locking member 62 at the forward end thereof dimensioned to be lockingly received in tang portion locking notch 46 as is shown in FIG. 2. The rocker arm body also includes a rear end portion 64 extending axially outward from between sides 10,12 at rear or second end 16 thereof. A leg 66 integral with the rocker arm body extends downwardly from rear end portion 64 in spaced relation to rear or second end 16 and generally coextensive therewith. As best seen in FIG. 5, the width of body 60 is such that it is closely slidably received between the inner walls of sides 10,12 to accommodate selective pivotal movement thereof about pin 26. In addition, the conformation of rocker arm body 60 is such that when the blade is in the retracted position shown in FIG. 1 or the extended position shown in FIG. 2, it will be substantially flush with the top side edges 30 of the handle. As will be best seen from both FIGS. 1 and 5, the rocker arm body thus defines a wall-like area extending between sides 10,12 so as to define, in combination with channel 36, a receiving pocket for at least cutting edge portion 40 of blade B.

Figure 4:
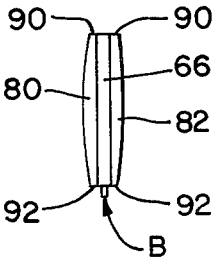
FIG. 4 is an end view of the knife handle taken along lines 4—4 of FIG. 1; and, FIG. 5 is a cross-sectional view taken along lines 5—5 of FIG. 1.

Locking member release D comprises a pair of identical but opposite rear bolster plates 80,82 as best shown in both FIGS. 2 and 4. The plates themselves are rigidly affixed to rear end portion 64 of the rocker arm body as at, for example, leg 66 by means of pins 84,86. Plates 80,82 are configured so that when so mounted, the forward end edge of each (FIG. 2) is closely spaced toward the tapered rear end edge 34 of an associated side 10 or 12. With continued reference to FIGS. 2 and 4, the top side edge 90 and bottom side edge 92 of each bolster plate 80,82 along with rocker arm rear end portion 64 and leg 66 are dimensioned and configured so that when the knife is in either the extended or retracted position, the aforementioned components will be flush with the contour of handle sides 10,12. In addition, these components define an end area for the blade receiving pocket. Thus, locking member release D will appear to be integral with or a part of the remainder of the construction for handle sides 10,12 in the manner typically encountered with folding knife designs. As a result, the locking member release is effectively concealed when simply viewing the knife and/or at least upon an initial examination thereof. While in the preferred embodiment, rear bolster plates 80,82 are constructed from metal in the same manner as front bolsters 22 for purposes of providing a strong construction for the locking member release, other materials and constructions could also be advantageously employed.

Figure 3:
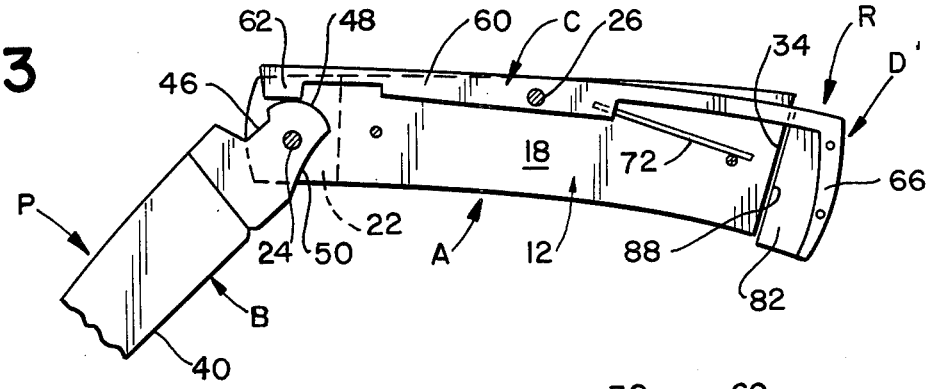
FIG. 3 is a view similar to FIG. 2 showing release of the locking mechanism to permit arcuate or pivotal movement of the blade.

FIG. 2 shows the subject locking knife construction in the blade extended or operative position with downwardly depending locking member 62 of rocker arm C received in tang portion locking notch 46 for mechanically locking the blade in position. When it is desired to move the blade from the position of FIG. 2 to the retracted position of FIG. 1, it is necessary to first release locking member 62 from engagement with notch 46 in the manner shown in FIG. 3. To accomplish such release, a downward release force R is applied against locking member release D so as to overcome the opposite force of leaf spring 72 and thereby move the locking member release in a generally linear fashion relative to rear end edges 34 of handle sides 10,12. Since rocker arm body 60 is being pivoted about pivot mounting 26, the above described tapered configuration for rear end edges 34 will accommodate the necessary relative movement between release D and these rear end edges. Without the tapered relationship, it would be necessary to provide additional clearance between handle side rear end edges 34 and bolster plate forward end edges 88 to accommodate the necessary relative movement therebetween. If such additional clearance were to be provided, the overall knife construction would not render or give the appearance of locking member release D being integral with the remainder of the handle construction when the blade is in either the extended or retracted position.

Movement of locking release D in direction R pivots elongated body 60 about pin 26 so that locking member 62 is lifted from locking engagement with locking notch 46. Thereafter, blade B may be pivoted in direction P for purposes of moving the blade from the extended position of FIG. 2 to the retracted position of FIG. 1. Once such arcuate movement is begun, the force exerted on release D may itself be released and locking member 62 will simply ride on cam surface 48 under the urging of leaf spring 72. This cam surface and relief-like area 50 are configured such that when the blade assumes the fully retracted position of FIG. 1, there will be cooperative engagement between locking member 62 and relief-like area 50 for exerting a small biasing force against the blade tending to retain it in the retracted position. In the retracted position, of course, cutting edge portion 40 and at least a portion of the blade adjacent thereto is protectively received in the pocket area defined between handle sides 10,12 and rear bolster plates 80,82.

When it is desired to move the knife blade in the position of FIG. 1 to the position of FIG. 2, it is merely necessary to exert a pivoting force against the blade. Locking member 62 under the urging of leaf spring 72 will engage and follow the contour of relief-like area 50 and cam surface 48 until it is received in locking notch 46 to again lock the blade in the extended position.

The invention has been described with reference to the preferred embodiment. Obviously, modifications and alterations will occur to others upon the reading and understanding of this specification. It is intended to include all such modifications and alterations insofar as they come within the scope of the appended claims or the equivalents thereof.

Having thus described the invention, it is now claimed:

1. A self locking knife construction comprising in combination:

a handle including a pair of laterally spaced apart parallel side portions secured in a fixed relationship to each other for defining an elongated knife blade receiving channel therebetween, said handle side portions having elongated top and bottom edges, front end portions, and rear edges extending transversely between said top and bottom edges;

a knife blade having an elongated cutting edge portion and a tang portion, said blade being pivotally mounted at said tang portion to said handle intermediate said front end portions of said handle side portions for allowing pivotal movement of said blade between an extended position having said cutting edge portion thereof exposed and a retracted position having said cutting edge portion thereof received in said channel, said tang portion including a locking notch therein for receiving a releasable locking member when said blade is in said expanded position for locking said blade against movement toward said retracted position;

an elongated rocker arm positioned intermediate said handle side portions to extend over at least a major portion of the length of said handle side portions along said top edges thereof to form a wall-like area between said handle side portions and thereby define a pocket for said blade cutting edge portion when said blade is in said retracted position, said rocker arm including a forward end having a locking member which lockingly engages said tang portion locking notch when said blade is pivotally moved to said extended position, said rocker arm including a rearward end portion positioned axially beyond said rear edges of said handle side portions and extending along said rear edges of said handle side portions between said top and bottom edges thereof;

said rocker arm being pivotally mounted to said handle on a rocker arm pivot axis located intermediate said front end portions of said handle side portions and said rear edges thereof for movement of said rocker arm forward end toward and away from said blade tang portion;

spring biasing means received in said pocket acting against said rocker arm rearwardly of said rocker arm pivot axis to continuously urge said locking member into engagement with said tang portion; and, a handle end fixedly secured to said rocker arm rearward end portion adjacent said rear edges of said handle side portions, said handle end being selectively movable with said rocker arm rearward end portion relative to said rear edges of said handle side portions against the force of said spring biasing means to pivot said rocker arm about said rocker arm pivot axis and thereby move said locking member out of engagement with said locking notch for allowing movement of said blade from said extended to said retracted position.

2. The knife as defined in claim 1 wherein said spring biasing means comprises a leaf spring having one end thereof fixedly secured to said rocker arm rearwardly of said rocker arm pivot axis and with a portion of said leaf spring adjacent the other end thereof acting against means used for securing said handle side portions in said fixed relationship to each other.

3. The knife as defined in claim 1 wherein the outer edge of said rocker arm extends substantially flush and coextensive with said top edges of said handle side portions over the longitudinal extent thereof at least when said blade is in either of said extended and retracted positions; said rocker arm rearward end portion including a leg portion spaced outwardly from and generally coextensive with said rear edges of said handle side portions; and, said handle end comprising a pair of bolster plates fixedly secured to opposite sides of said rocker arm leg portion.

4. The knife as defined in claim 3 wherein said rear edges of said handle side portions taper from said top edges of said handle side portions to said bottom edges thereof in a direction toward said front ends thereof to facilitate selective movement of said handle end relative to said rear edges at least when it is desired to release the locking relationship between said locking member and locking notch, each said bolster plate having an inner end edge closely spaced to said handle side portion rear edges to give the appearance at least when said blade is in either of said extended and retracted positions that each of said bolster plates is fixedly secured to an associated handle side portion.

5. The knife as defined in claim 4 wherein said rocker arm leg portion and said bolster plates define a portion of the side walls and an end wall for said pocket.

6. The knife as defined in claim 3 wherein the opposite side edges of said bolster plates are substantially flush with the contour of the opposite longitudinal side edges of said handle side portions at least when said blade is in either one of said extended and retracted positions.

7. A self locking knife construction comprising in combination:

a handle including a pair of laterally spaced apart parallel side portions secured in a fixed relationship to each other for defining an elongated knife blade receiving channel therebetween having forward and rear ends, the ends of said handle side portions at said channel rear end tapering coextensively toward said channel forward end from one longitudinal side edge to the other longitudinal side edge thereof;

a knife blade having an elongated cutting edge portion and a tang portion, said blade being mounted at said tang portion to said handle in said channel adjacent said channel forward end for allowing pivotal movement of said blade between an extended position having said cutting edge portion exposed and a retracted position having said cutting edge portion received in said channel, said tang portion including a locking notch therein for receiving a releaseable locking member when said blade is in said extended position for locking said blade against movement toward said retracted position;

an elongated rocker arm pivotally mounted in said channel adjacent said handle side portion one longitudinal side edges to extend over at least a major portion of the length of said handle and form a wall-like area between said handle side portions to thereby define a pocket for said blade cutting edge portion when said blade is in said retracted position, said rocker arm including a forward end having a locking member lockingly engage said blade tang portion locking notch when said blade is in said extended position and further including a rearward end extending outwardly beyond said channel rear end, said rocker arm rearward end including a leg portion extending generally coextensive with said channel rear end;

a pair of handle bolster members fixedly secured to said rocker arm leg portion in an opposed relationship to each other with the inner end edge of said bolster member being closely spaced to the tapered end of an associated handle side portion and defining a portion of the side walls and an end wall for said pocket, said bolster members and rocker arm rearward end being selectively movable relative to said handle side portion tapered ends to pivot said rocker arm about its pivot mounting and thereby move said locking member out of engagement with said locking notch for allowing movement of said blade from said extended to said retracted position, said bolster members further being positioned and configured to give the appearance of being a part of the associated handle side portions at least when said blade is in either of said extended and retracted positions; and, a leaf spring disposed in said pocket having one end thereof fixedly secured to said rocker arm rearwardly of the pivot mounting therefor and with a portion of said leaf spring adjacent the other end thereof acting against means used for securing said handle side portion in said fixed relationship to each other for continuously pivotally urging said locking member into engagement with said tang portion.

* * * * *